US007966772B2

(12) United States Patent
Bartels et al.

(10) Patent No.: US 7,966,772 B2
(45) Date of Patent: Jun. 28, 2011

(54) TUBULAR INSERT FOR EXCAVATED HOLE WITH SAFETY COVER

(75) Inventors: Bernard George Bartels, Ancaster (CA); Darren Bernard Bartels, Ancaster (CA); Marc Beaudry, Boucherville (CA); Darren Van Buuren, Grassie (CA)

(73) Assignee: Super Sucker Hydro Vac Service, Inc. (CA)

( * ) Notice: Subject to any disclaimer, the term of this patent is extended or adjusted under 35 U.S.C. 154(b) by 541 days.

(21) Appl. No.: 11/798,654

(22) Filed: May 16, 2007

(65) Prior Publication Data

US 2007/0295421 A1 Dec. 27, 2007

(30) Foreign Application Priority Data

May 16, 2006 (CA) ..... 2547084

(51) Int. Cl.
*E04H 12/00* (2006.01)

(52) U.S. Cl. ..... 52/20; 52/40; 52/169.7; 52/169.13; 52/298

(58) Field of Classification Search ..... 52/40, 169.13, 52/170, 169.9, 297, 298, 19, 20, 169.7
See application file for complete search history.

(56) References Cited

U.S. PATENT DOCUMENTS 108,814 A * 11/1870 Moseley ..... 405/222
215,947 A * 5/1879 McMackin ..... 138/157
405,658 A * 6/1889 Campany ..... 52/170
837,820 A * 12/1906 Folsom ..... 52/168
1,263,789 A * 4/1918 Morrison ..... 52/302.5
1,596,657 A * 8/1926 Heber ..... 52/168
1,905,794 A * 4/1933 Burke ..... 52/220.1
1,982,569 A * 11/1934 Byrd ..... 52/298
2,210,441 A * 8/1940 Bachman ..... 52/297
2,385,869 A * 10/1945 Lane ..... 405/216
2,897,553 A * 8/1959 Gorrow ..... 52/835
3,163,908 A * 1/1965 Lawmaster ..... 249/164
3,428,077 A * 2/1969 Scarfe ..... 137/363
3,857,575 A * 12/1974 Lee ..... 280/1
3,938,285 A * 2/1976 Gilbu ..... 52/20
3,974,599 A * 8/1976 Grosh ..... 52/20
4,014,367 A * 3/1977 Milo ..... 138/89
4,492,496 A * 1/1985 Arnold ..... 405/303
4,543,757 A * 10/1985 Cosgrove ..... 52/295
4,644,715 A * 2/1987 Burell et al. ..... 52/170
4,697,959 A * 10/1987 Kinnan ..... 405/232
4,702,057 A * 10/1987 Phillips ..... 52/514
4,779,389 A * 10/1988 Landers ..... 52/169.13
5,010,957 A * 4/1991 Kenner ..... 166/379
5,138,806 A * 8/1992 Marx et al. ..... 52/170
5,291,917 A * 3/1994 Yamanaka ..... 137/363
5,337,469 A * 8/1994 Richey ..... 29/402.12
5,571,229 A * 11/1996 Fitzsimmons et al. ..... 473/481
5,625,988 A * 5/1997 Killick ..... 52/298

(Continued)

*Primary Examiner* — Robert J Canfield
*Assistant Examiner* — Babajide Demuren
(74) *Attorney, Agent, or Firm* — Steven M. Greenberg, Esq.; Carey Rodriguez Greenberg & Paul LLP

(57) ABSTRACT

A tubular insert sleeve for an excavated hole and a safety cover fitted to cover an operatively upper end of the insert sleeve are provided to maintain the integrity of an excavated hole and limit access to the hole in order to improve the safety of the public. The sleeve is made of cooperating segments which can easily be separated and which a form a sleeve when assembled. The operatively upper end of the assembled sleeve forms an outwardly extending bell-shaped end of greater outer diameter to define an outwardly extending flange which is more easily grasped for removal of the sleeve from an excavated hole.

1 Claim, 8 Drawing Sheets

U.S. PATENT DOCUMENTS 5,752,349 A * 5/1998 Fitzsimmons et al. ..... 52/165
5,819,468 A * 10/1998 Jollie ..... 47/32.4
5,970,667 A * 10/1999 Thaler ..... 52/219
6,176,052 B1 * 1/2001 Takahashi ..... 52/232
6,256,961 B1 * 7/2001 Byrnes ..... 52/835
6,488,440 B1 * 12/2002 Hill ..... 404/25
6,612,377 B2 * 9/2003 Rynard ..... 172/25
D537,490 S * 2/2007 McAllister et al. ..... D21/702
7,325,790 B2 * 2/2008 Lee ..... 256/65.14
2003/0066662 A1 * 4/2003 Rynard ..... 172/25

* cited by examiner

TUBULAR INSERT FOR EXCAVATED HOLE WITH SAFETY COVER

FIELD OF INVENTION

This invention relates to a tubular insert for use with excavated holes of the kind which are dug to receive elongated objects such as utility poles. In particular, the invention relates to a combination of the tubular insert with a safety cover to discourage tampering and mitigate the circumstances in which anything may accidentally fall into the hole.

BACKGROUND OF THE INVENTION

It is quite common for a commercial excavator to dig a series of spaced holes for receiving a number of respective elongated objects, such as utility poles. The excavation of the holes may take place before the utility poles can be located into the holes and therefore the holes may be left in a condition to receive the poles for a day or more. Because this is not safe, the holes are usually covered over by any convenient cover such as a board or pallet and the public danger may be signaled by a warning pylon placed over the board.

An improvement over such an improvised safety cover is to provide a tubular insert sized to fit the diameter of the hole and to place the insert into the hole. A protective cap having an internal diameter which is sized to fit over the external diameter of the insert is used to seal off the hole. The insert has the advantage of retaining surrounding soil and dirt so that it does not collapse into the hole thereby preserving the hole so that it can receive a utility pole at a later time.

The insert is usually provided in lengths which are commensurate with the depth of the hole and may vary in lengths of several feet to ten feet or more. One problem which arises with such inserts is that they are preferably withdrawn from the surrounding hole in order to be reused at another job site. With deep holes, this becomes particularly difficult because the entire length of the insert must be withdrawn and if this is done after the utility pole has been installed, the tubular insert must be lifted the entire height of the utility pole as well. Another problem which arises is that the smooth tubular surface of the insert is difficult to grasp for removal. In addition, the diameter of such tubes must in some cases be quite large and storage for transportation takes up a lot of space.

An object of this invention is to provide a tubular insert for excavated holes which is easier to remove from an excavated hole and which is easier to transport to and from a job site.

SUMMARY OF THE INVENTION

The invention provides a tubular insert sleeve for an excavated hole and a safety cover in which the sleeve is made of cooperating segments which can easily be separated and which form a sleeve when assembled. In a preferred embodiment, the sleeve is made of two cooperating segments, as will be described, each segment extending the full height of the sleeve so that the joint between segments extends longitudinally along the height of the assembled sleeve.

In accordance with another aspect of the invention, the operatively upper end of the assembled sleeve has an outwardly extending "bell-shaped" end of greater outer diameter than the outer diameter of the remainder of the sleeve. The upper end thereby defines an outwardly extending flange which is more easily grasped for removal of the sleeve from an excavated hole and which in use will rest on the ground to surround the excavated hole.

It is preferred that the sleeve or at least its upper portion be coloured bright orange or a so-called "safety green" so as to alert the public of the potential danger. The cover also is preferably brightly coloured orange or green.

BRIEF DESCRIPTION OF ILLUSTRATIONS

In order to better understand the invention, a preferred embodiment is described below with reference to the accompanying illustrations, in which.

Figure 1:
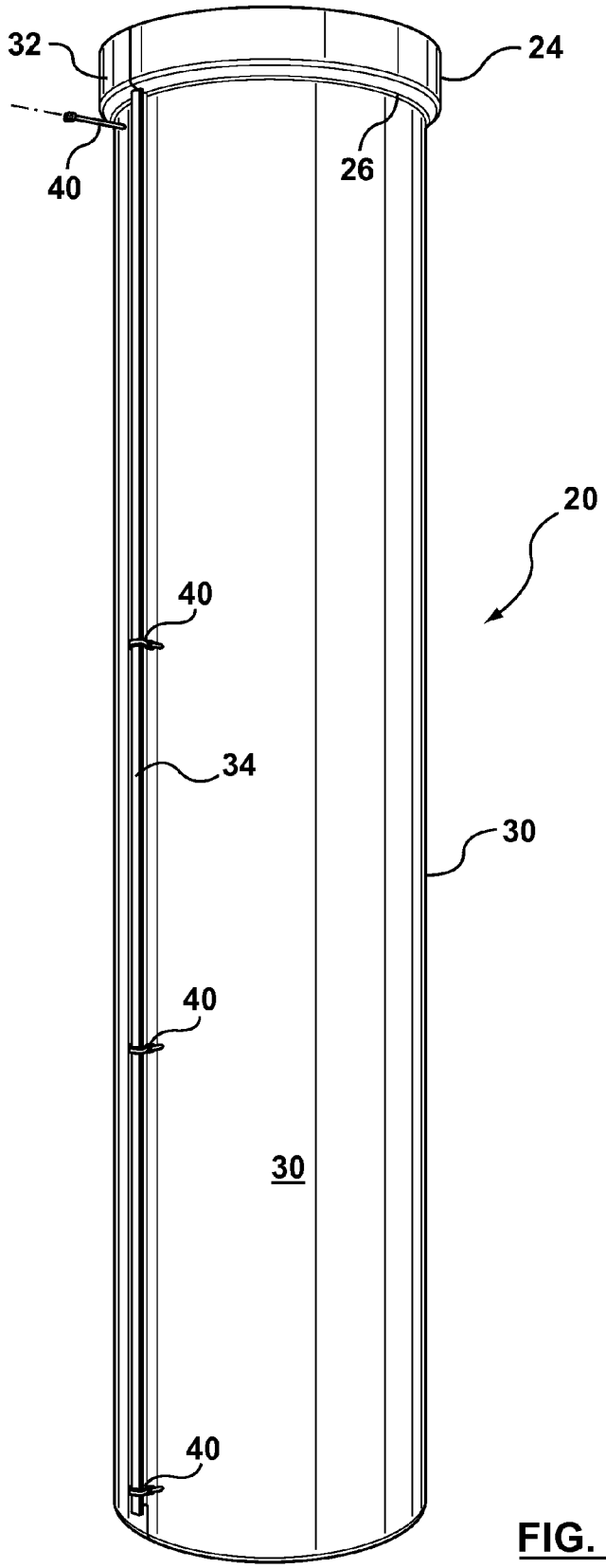
FIG. 1 is a front perspective view showing an assembled sleeve made in accordance with the invention.
Figure 8:
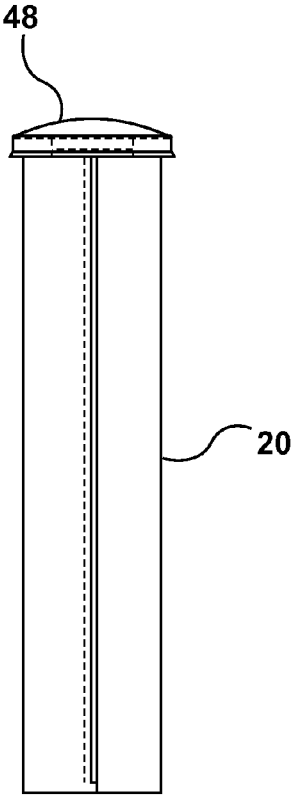
Figure 9:
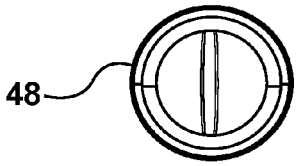
FIG. 9 is a bottom plan view of the safety cover of FIG. 5.
Figure 10A:
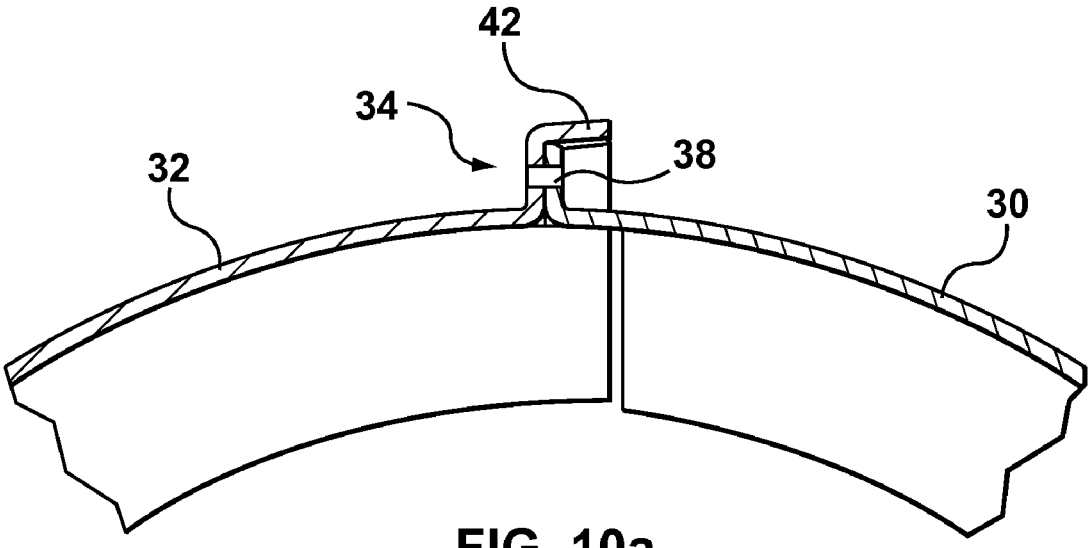
Figure 10B:
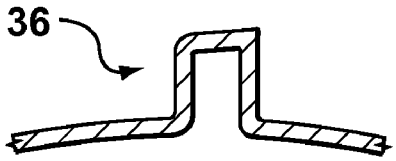
Figure 11:
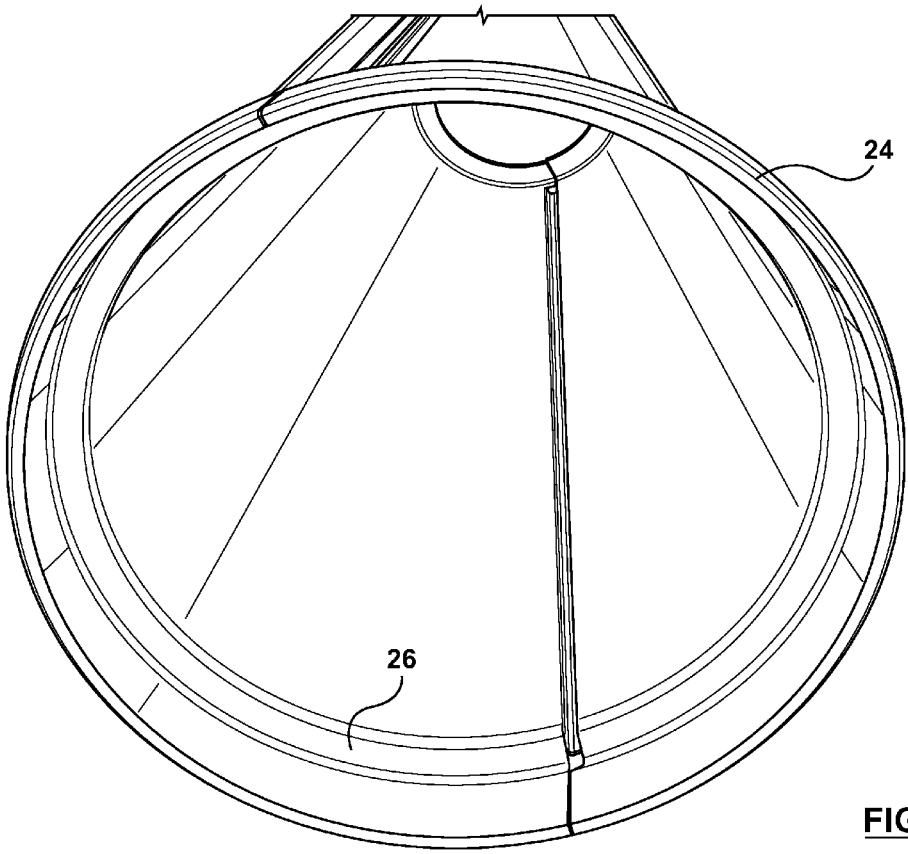
Figure 12:
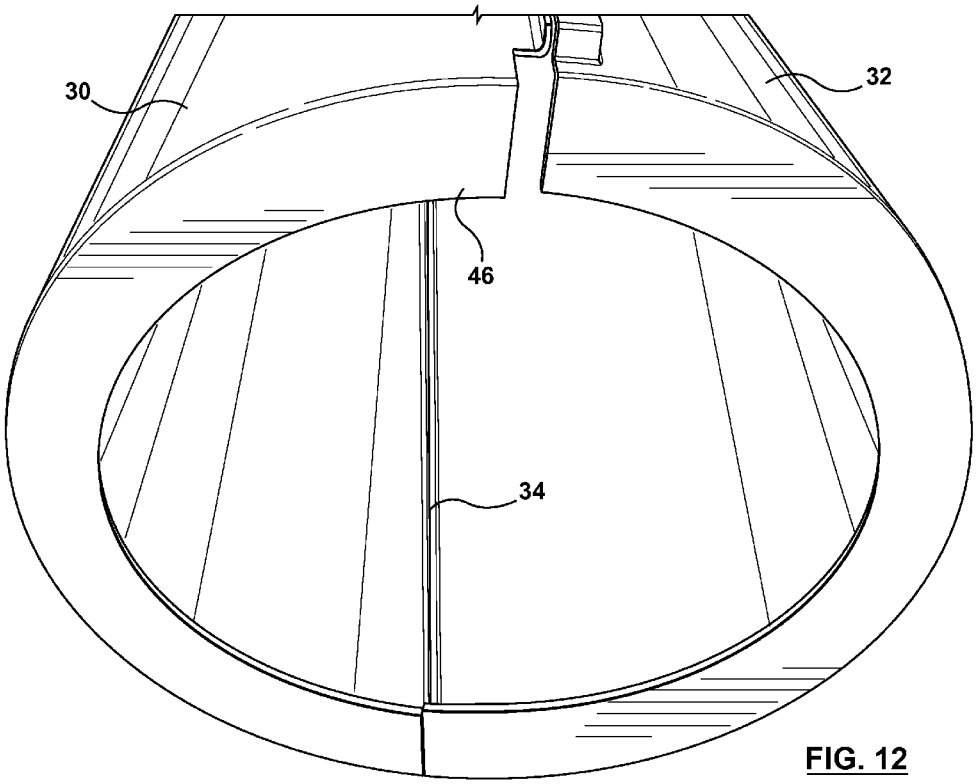
Figure 13:
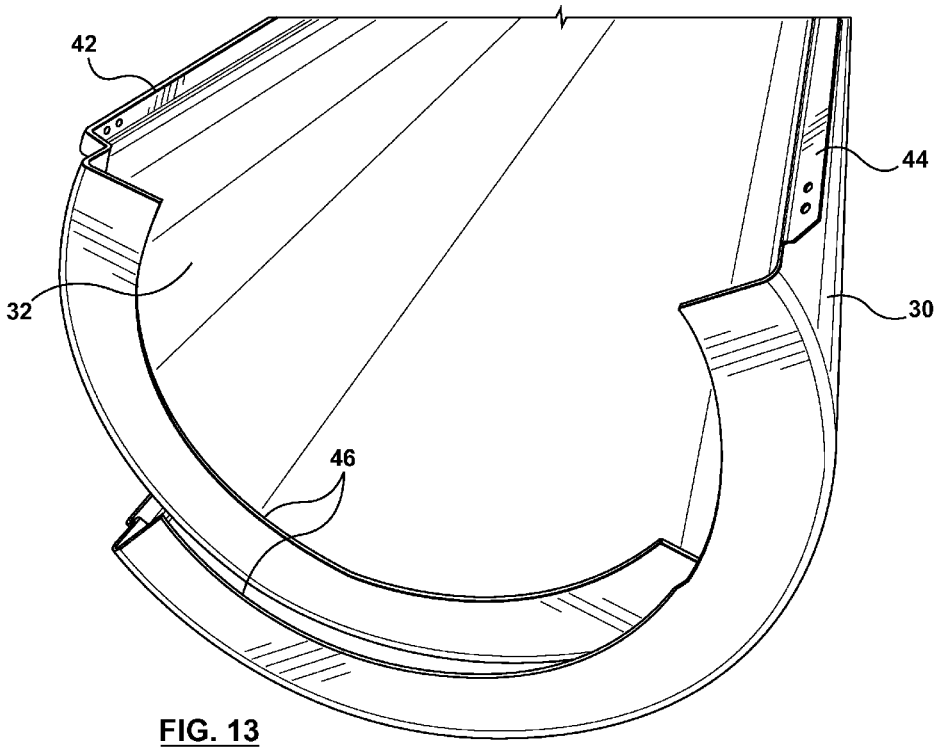

FIG. 10*a* is a detail view of a section B-B drawn through FIG. 8;

FIG. 10*b* is a similar view to FIG. 10*a* showing a rib formed during moulding;

FIG. 11 is perspective view showing a top end of the sleeve of FIG. 1;

FIG. 12 is perspective view showing a bottom end of the sleeve of FIG. 1; and FIG. 13 is perspective view showing two segments for forming a sleeve in nested configuration.

DESCRIPTION OF PREFERRED EMBODIMENT WITH REFERENCE TO ILLUSTRATIONS

Figure 3:
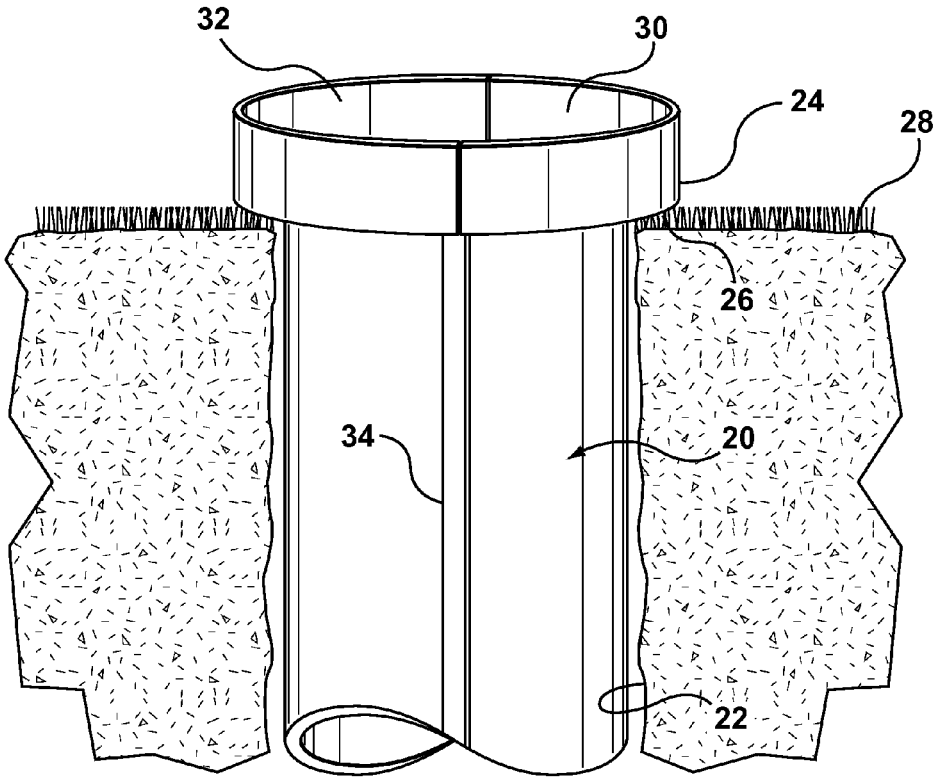
FIG. 3 is a sketch showing a portion of the sleeve of FIG. 1 in use inserted into an excavated hole.

A tubular insert sleeve made in accordance with the invention is generally indicated in FIG. 1 by reference numeral 20. In use, the tubular insert sleeve 20 will be inserted into an excavated hole 22 shown in FIG. 3. The operatively upper end of the tubular insert sleeve 20 has an outwardly extending "bell-shaped" end 24 of greater outer diameter than the outer diameter of the remainder of the sleeve 20. The upper end thereby defines an outwardly extending flange 26 which as shown in FIG. 3 will rest on the ground 28 to surround the excavated hole 22. Because the upper portion of the sleeve is proud of the excavated hole 22 and the flange 26 provides a bearing surface, the tubular insert sleeve is more easily grasped for removal of the sleeve from the excavator hole 22.

Conveniently, the sleeve is made of a pair of cooperating segments 30, 32 which can easily be separated and which form a sleeve when assembled. In the embodiment illustrated, each segment 30, 32 extends the full height of the sleeve 20 so that a pair of joints 34 between segments extend longitudinally along the height of the assembled sleeve on opposite sides thereof.

Conveniently, the entire tubular insert sleeve is rotation moulded from a single mould. During moulding, a joint 34 which is shown in more detail in FIG. 10, is formed from an outwardly extending hollow rib 36 drawn in FIG. 10*b* adjacent to FIG. 10*a*. After the moulding, the ribs 36 are drilled with vertically spaced apertures 38 along the height of the tubular insert sleeve 20 and the ribs 36 are subsequently cut to separate the respective segments 30, 32 forming the tubular insert sleeve.

In this way, the apertures 38 from both segments 30, 32 are aligned with each other. In order to secure the two segments together, a number of tie strips 40 (FIG. 1) corresponding in number to the apertures 38 are inserted through the apertures.

Conveniently, during transportation, the segments 30, 32 may be separated from each other and transported in a nested configuration as shown in FIG. 13. FIG. 13 also shows the joint 34 in its component parts, including an L-shaped section 42 which is integral with segment 32 and a straight wall section 44 which is integral with segment 30.

Figure 4:
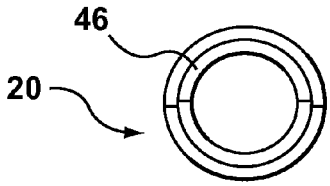
FIG. 4 is a top plan view of the sleeve of FIG. 2 without safety cover.
Figure 5:
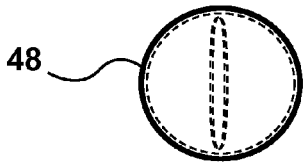
FIG. 5 is a top plan view of the safety cover shown in FIG. 2.
Figure 6:
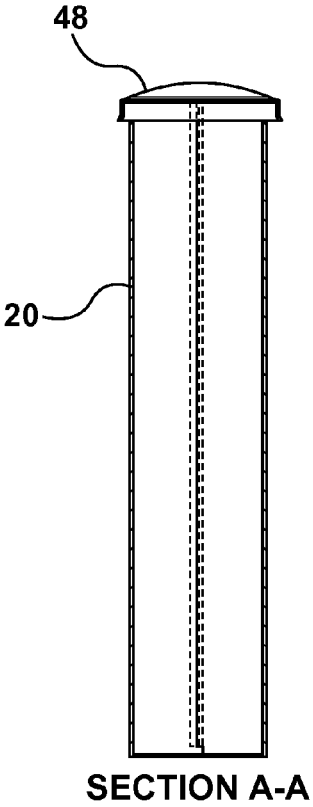
FIGS. 6, 7, 8 are various side elevation views of the sleeve of FIG. 2.
Figure 7:
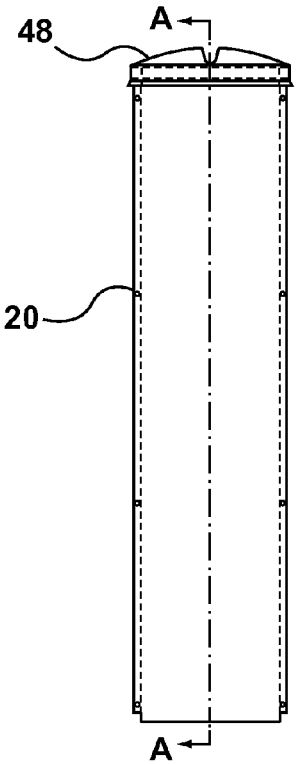

In order to improve the stability of the tubular insert sleeve 20, the bottom end, opposite from the bell-shaped end 24 is formed with an inwardly directed flange 46 shown in both FIGS. 12 and 13. The flange 46 is also visible in the top view of FIG. 4. The bottom end is aside from the flange 46, open.

Figure 2:
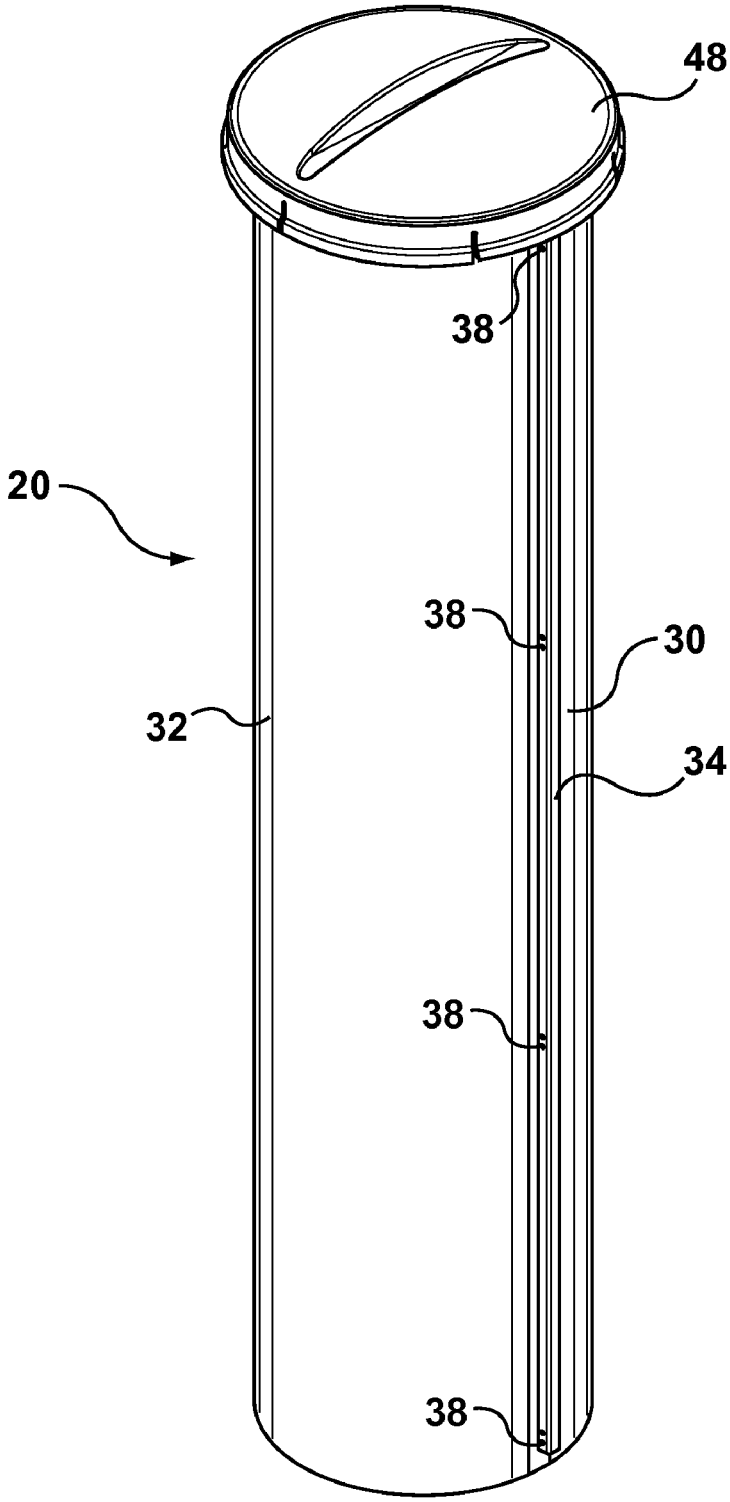
FIG. 2 is a drawing similar to FIG. 1 showing an assembled sleeve in accordance with the invention with a safety cover at the top end thereof.

In use, the entire tubular insert sleeve assembly as illustrated in FIG. 2 is inserted into an excavated hole 22 as shown by FIG. 3. The sleeve then operates to maintain the integrity of the excavated hole 22 by retaining the surrounding dirt or material from which the hole has been excavated and preventing same from collapsing into the hole 22.

In order to safeguard the public from accidentally falling into the hole or dropping objects into the hole, the upper bell-shaped end 24 is covered with a safety cover 48 which is dimensioned to snap fit over the bell-shaped end 24. The choice of design for the cover 48 may vary considerably but it is intended that the cover will fit snugly over the upper end of the tubular insert sleeve 20 so that it is not easily removed and tamper proof. Preferably, the cover 48 and the top end of the sleeve 20 are coloured a bright safety orange or green.

When a utility pole or other elongated object is ready to be installed into the excavated hole 22, the tubular insert sleeve 20 may be removed from the hole 22. Depending on the nature of the ground surrounding the hole 22, it may be necessary to leave the tubular insert sleeve 20 in place when a utility pole or the like is installed in which case, the safety cover 48 is first removed. The upper bell-shaped end 24 of the tubular insert sleeve 20 is then grasped in order to raise the tubular insert sleeve until it is withdrawn from the hole 22. As the tubular insert sleeve progresses upwardly, access to the tie strips 40 allows a worker to sever the tie strips in order that the segments 30, 32 may be separated from each other. Thus, it is not necessary to withdraw the tube over the height of the utility pole or other object in order to withdraw the insert sleeve from the job site. Once removed, the segments 30, 32 are once again nested together as illustrated by FIG. 13 in order to be transported to the next job site.

It will be understood that several variations may be made to the above described invention as will be apparent to those skilled in the art. In particular, the shape and configuration of the safety cover may vary as required. It will also be appreciated that other fasteners than the tie strips 40 may be used to secure segments to each other and that the number of segments may also vary. In addition, the manner of forming a joint between segments may be changed in accordance with any design choice that is preferred. Finally, it will be appreciated that the tubular insert sleeve may be made in a variety of lengths and have a number of different diameters suited to the diameter of the intended excavation hole. For some applications where the tubular insert sleeve is perhaps shorter in length, a grooved joint coupling whereby the cooperating segments will slide longitudinally relative to each other may be desirable. Alternatively, the segments may also be hinged relative to each other. Other such variations will be apparent to those skilled in the art.

The invention claimed is:

1. A tubular insert sleeve for insertion into an excavated hole, comprising:

at least two longitudinally extending segments adapted to cooperate with each other to form the tubular insert sleeve;

the tubular insert sleeve having a cylindrical main portion having a pre-determined first external diameter selected to fit in the excavated hole so that an exterior surface of the main portion engages walls of the excavated hole when the tubular insert sleeve is inserted therein;

the main portion extending from a bottom end of the tubular insert sleeve adapted for insertion into the excavated hole toward an upper portion of the tubular insert sleeve adjacent an upper end of the tubular insert sleeve remote from the bottom end;

the upper portion having a pre-determined second external diameter greater than the first external diameter and selected to be larger than the excavated hole;

the main portion being longitudinally substantially longer than the upper portion;

there being an abrupt discontinuity between the first external diameter and the second external diameter so that the upper end of the sleeve defines an outwardly extending annular flange providing a bearing surface for removal of the tubular insert from the excavated hole;

the tubular insert sleeve having an inwardly directed annular flange at the bottom end; and the tubular insert sleeve being open at the bottom end a snug fitting and removable safety cover adapted to extend over the upper end in order to cover the excavated hole.

* * * * *

UNITED STATES PATENT AND TRADEMARK OFFICE

CERTIFICATE OF CORRECTION

PATENT NO. : 7,966,772 B2
APPLICATION NO. : 11/798654
DATED : June 28, 2011
INVENTOR(S) : Bernard George Bartels et al.

It is certified that error appears in the above-identified patent and that said Letters Patent is hereby corrected as shown below:

Title page, item [57]
- in the abstract, at lines 5-7 read "The sleeve is made of cooperating segments which can easily be separated and which a form a sleeve when assembled." Please remove the "a" between "which" and "form a sleeve when assembled."

Column 4, line 42
- add the word "sleeve" after "tubular"

Column 4, line 45
- insert the words --and having-- between "bottom end" and "a"

Signed and Sealed this
Seventeenth Day of April, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,966,772 B2
APPLICATION NO. : 11/798654
DATED : June 28, 2011
INVENTOR(S) : Bernard George Bartels et al.

It is certified that error appears in the above-identified patent and that said Letters Patent is hereby corrected as shown below:

Title page, item [57]
- in the abstract, at lines 5-7 read "The sleeve is made of cooperating segments which can easily be separated and which a form a sleeve when assembled." Please remove the "a" between "which" and "form a sleeve when assembled."

Column 4, line 42
- add the word "sleeve" after "tubular insert"

Column 4, line 45
- insert the words --and having-- between "bottom end" and "a"

This certificate supersedes the Certificate of Correction issued April 17, 2012.

Signed and Sealed this
Twenty-fifth Day of September, 2012

David J. Kappos

David J. Kappos
*Director of the United States Patent and Trademark Office*